US006217494B1

(12) United States Patent
Sandoval

(10) Patent No.: US 6,217,494 B1
(45) Date of Patent: Apr. 17, 2001

(54) ADJUSTABLE REVOLVING-WEIGHT LIFTING BAR

(76) Inventor: Martin Lee Sandoval, 22213 Ibex Ave., Hawaiian Gardens, CA (US) 89617

( * ) Notice: Subject to any disclaimer, the term of this patent is extended or adjusted under 35 U.S.C. 154(b) by 0 days.

(21) Appl. No.: 09/450,053

(22) Filed: Nov. 29, 1999

(51) Int. Cl.[7] ..... A63B 21/072
(52) U.S. Cl. ..... 482/106
(58) Field of Search ..... 482/92, 93, 106, 482/57, 62, 107, 108

(56) References Cited

U.S. PATENT DOCUMENTS

| | | | | |
|---|---|---|---|---|
| 4,288,073 | * | 9/1981 | Petrachonis et al. | 482/106 |
| 4,531,729 | * | 7/1985 | Wrinkle | 482/106 |
| 4,618,142 | * | 10/1986 | Joseph | 482/106 |
| 5,221,244 | * | 6/1993 | Doss | 482/106 |
| 5,354,249 | * | 10/1994 | Raley | 482/57 |

* cited by examiner

*Primary Examiner*—S R Crow

(74) *Attorney, Agent, or Firm*—Charles H. Thomas

(57) ABSTRACT

A rotatable exercise bar having a pair of the handgrips that are longitudinally and transversely offset from each other is provided with adjustment mechanisms that allow both the transverse and longitudinal distances of separation between the handgrips to be varied according to the comfort of the user. The adjustment mechanisms of the rotatable exercise bar permit customization of the exercise bar to accommodate most different physiques, arm lengths, muscles strengths and coordination capabilities among different individuals. Adjustment of the longitudinal distance of separation between the handgrips is provided by mounting the handgrips slidably upon the longitudinally and transversely separated handgrip sections of the bar. Releaseable clamps are located at both ends of each handgrip. Each handgrip may thereby be selectively positioned at a desired location along its associated handgrip section of the bar. The transverse section of the bar that connects the handgrip sections together is formed of a pair of telescoping members. A releaseable locking mechanism is provided to control the extent to which the inner telescoping member projects transversely out from the outer telescoping member. Selected positioning and releaseable locking of the telescoping members thereby permits adjustment of the transverse distance of separation between the exercise bar handgrips.

16 Claims, 5 Drawing Sheets

ADJUSTABLE REVOLVING-WEIGHT LIFTING BAR

BACKGROUND OF THE INVENTION

1. Field of the Invention

The present invention relates to a rotatable exercise bar of the type having handgrip sections which are both longitudinally and transversely offset from each other and which are gripped by the user who uses them to rotate the bar about a generally horizontal axis.

2. Description of the Prior Art

Rotary exercise bars have existed for many years as aids for developing not only a person's arm muscles, but muscles throughout the body. Conventional rotary exercise bars are provided with a pair of handgrip sections that are longitudinally and transversely offset from each other. Handgrips are rotatably mounted on the handgrip sections of the bar and are used to rotate the exercise bar by manipulation in the manner of pedals of a bicycle or the cranks on a two-handed sailboat winch. Outboard extensions from the handgrip sections are provided to support weights.

While holding the exercise bar in a generally horizontal orientation, the user grasps the handgrips that are disposed about the handgrip sections of the exercise bar. While holding the exercise bar at about chest level, the user pushes outward with one hand while pulling inward with the other hand. This action rotates the exercise bar about a generally horizontal axis lying somewhere in between the axes of the two transversely displaced handgrip sections of the bar. As the user's muscles are developed, it is typically advisable to increase the amount of weight on the outboard ends of the revolving weight-lifting bar to further enhance muscle development.

A very major problem that exists with conventional revolving or rotatable weight-lifting bars is that the handgrips are located at fixed distances of both longitudinal and transverse separation from each other. While these distances of separation may be appropriate for one user whose arms are of a particular length and who has a particular physique, the longitudinal and transverse distances of separation of the handgrip may be totally inappropriate for a person whose arms are of even a slightly different length, or who has even a slightly different physique.

When the distances of longitudinal and transverse separation between the handgrips of a revolving weight-lifting bar are too long or too short for the user, the transverse connecting section between the two handgrip sections of the bar will often strike the user's wrists, elbows, or forearms as the bar is rotated. This is both annoying and unpleasant for the user, and can result in painful bruises. Also, the contact between the transverse connection section of the weight-lifting bar and the user's wrists, elbows, and forearms disrupts the rhythm of rotation of the bar and reduces the effectiveness of muscle development. Additionally, an individual can experience muscle strain due to inappropriate handgrip separation distances. Also, inadequate muscle development may result. In addition, if the distances are not comfortable for the user, rotation of the revolving weight-lifting bar is often extremely wobbly.

SUMMARY OF THE INVENTION

The present invention involves an improved revolving or rotatable weight-lifting bar in which both the longitudinal and transverse distances of separation between the handgrip sections of the bar are adjustable. As a consequence, it is a relatively simple matter for the user to bring the handgrips closer together or separate them further apart both longitudinally and transversely, and to maintain the selected distances of separation until changes in those distances are desired.

A revolving or rotatable weight-lifting bar according to the invention can be customized for use by different individuals, and customized for use even by a single individual utilizing different weights on the outboard ends of the rotatable bar. As a result, the user totally avoids the disconcerting, and sometimes painful, impacts that result from rotation of the bar with the handgrips located in inappropriately spaced positions from each other.

Adjustment of the handgrip positions on the rotatable weight-lifting bar of the invention can be performed very easily and in a minimum of time. The clamps and locking members that are employed may take the form of set screws, locking pins, or any other conventional locking, latching, or catch mechanisms that may be utilized to releaseably secure members together.

In one broad aspect, the present invention may be considered to be an improvement in a rotatable exercise device. Such a device includes an elongated bar having a transverse section and a pair of longitudinal handgrip sections extending in opposite directions from opposite ends of the transverse section so that the handgrip sections are longitudinally and transversely offset from each other. Separate handgrips are disposed coaxially about and are rotatable relative to the handgrip sections of the elongated bar. According to the improvement of the invention, at least one of the handgrips is shorter in length than an associated handgrip section about which it is coaxially disposed. This handgrip is slidably positionable along its associated handgrip section at alternative selected longitudinal distances from the transverse section of the elongated bar. At least one clamp is provided for longitudinally immobilizing the handgrip relative to its associated handgrip section of the elongated bar. Nevertheless, the clamp permits free relative rotation between the handgrip and the elongated bar.

Preferably, both of the handgrip sections are provided with adjustable handgrips of this type. That is, both handgrips are preferably shorter in length than the associated handgrip sections about which they are respectively coaxially disposed and both of the handgrips are slidably positionable along their respective associated handgrip sections. At least one clamp is provided for each of the handgrips.

In a preferred embodiment of the invention, there are a pair of clamps for each adjustable handgrip. The clamps in each pair include inboard and outboard retaining rings disposed about the associated handgrip section at opposite ends of the handgrip. The retaining rings encircle the associated handgrip section and abut the ends of the handgrip located therebetween. Each retaining ring has a radial, internally tapped bore defined therein. The clamps further include set screws engaged in the radial bores of the retaining rings. The retaining rings are located at the opposing ends of each handgrip so that the handgrip is longitudinally entrapped between the retaining rings.

When the set screws are tightened, they immobilize the retaining rings relative to the associated handgrip section of the elongated bar. Thus, the handgrip, which is rotatable relative to the handgrip section of the elongated bar, may be moved either closer inboard or closer outboard to the transverse section of the bar that joins the handgrip sections together. This adjusts the longitudinal distance of separation between the handgrips. Preferably also, indicia are spaced at equal longitudinal intervals along each of the handgrip sections to provide visual aids in selecting the longitudinal distance of separation of each of the handgrips from the transverse section of the elongated bar. The transverse distance of separation between the handgrip sections of the elongated bar is also adjustable.

In another broad aspect, the invention may be considered to be a rotatable exercise device comprising an elongated bar formed with a pair of linear handgrip sections residing in mutually parallel alignment with each other and longitudinally and transversely offset from each other. Each of the handgrip sections has an outboard end for receiving weights thereon and an opposite inboard end. A connecting sections joins and extends between the inboard ends of the handgrip sections. The connecting section is formed of a pair of telescoping members, one of which fits slidingly within the other. The connecting section is provided with at least one and preferably a pair of locking members.

The locking members are engageable to immobilize the telescoping members relative to each other. The locking members are alternatively releaseable to permit the telescoping members to be extended and retracted relative to each other, thereby allowing the length of the connection section to be selectively adjusted. Preferably the locking members are formed as a pair of locking pins coaxially aligned relative to each other and engaging both the inner and outer telescoping members from diametrically opposite sides thereof.

At least one of the telescoping members is provided with either a plurality of openings therethrough or with detents therein to provide selected steps of adjustment of the extent to which the inner telescoping member extends into and protrudes from the outer telescoping member. Alternatively, the locking means may take the form of a wedging mechanism interposed between the inner and outer telescoping members. In any event, the extent of longitudinal extension and retraction between the telescoping members may be altered as desired when the locking mechanism is released. When the locking mechanism is engaged, the two telescoping members of the transverse connecting section of the rotatable elongated bar are immobilized relative to each other.

The invention may be described with greater clarity and particularity with reference to the accompanying drawings.

DESCRIPTION OF THE EMBODIMENT

Figure 1:
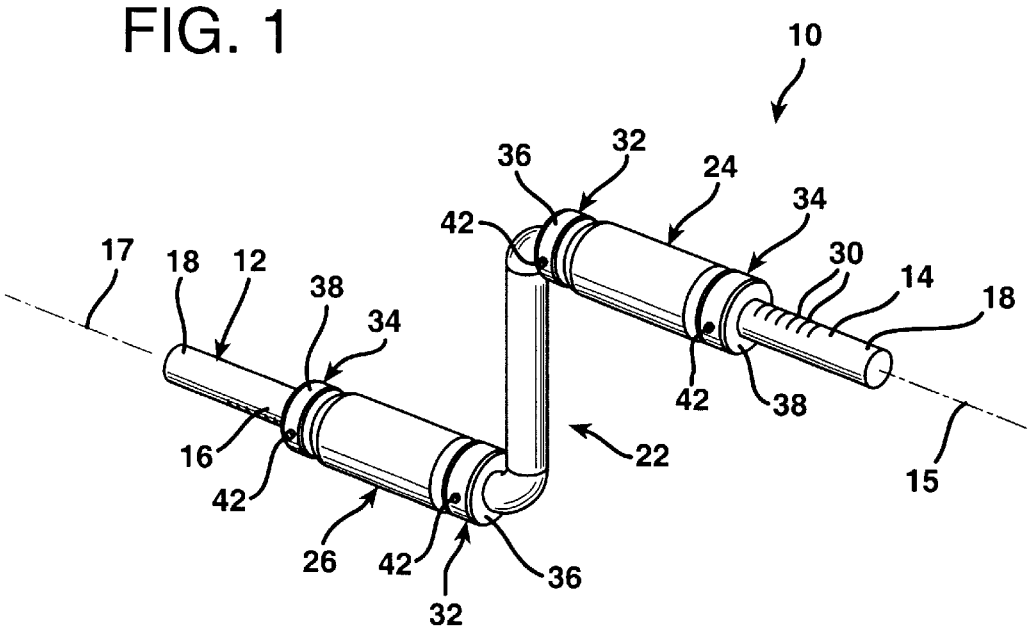
FIG. 1 is a perspective view of one preferred embodiment of the rotatable exercise device of the invention in which the longitudinal distance of offset between the handgrips is adjustable.
Figure 6:
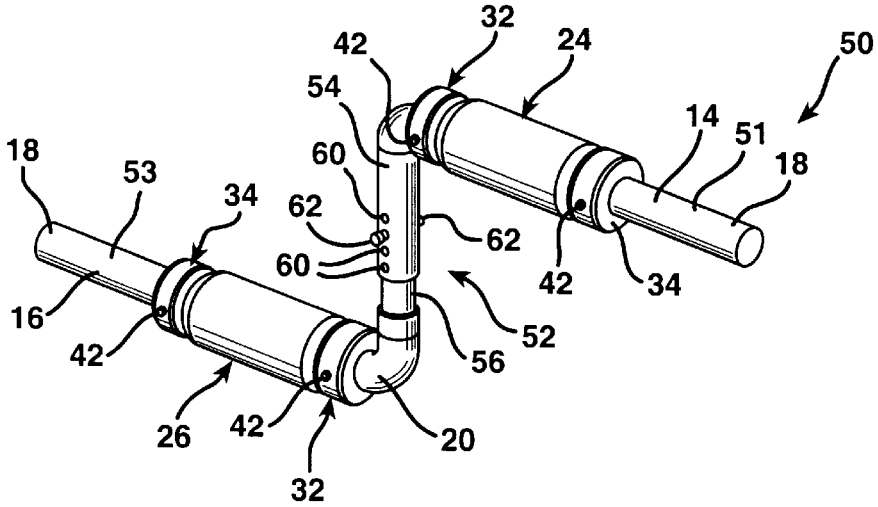
FIG. 6 is a perspective view of an adjustable rotatable exercise device in which both the longitudinal and the transverse offset distances of separation between the handgrips is adjustable.
Figure 2:
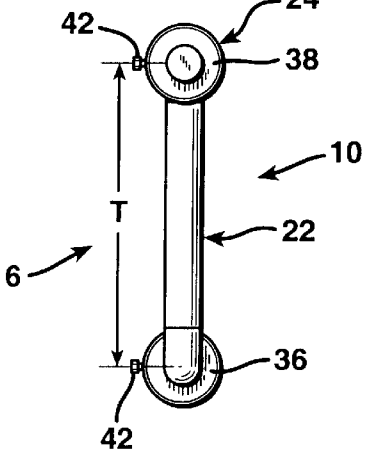
FIG. 2 is an end view of the rotatable exercise device shown in FIG. 1.
Figure 4:
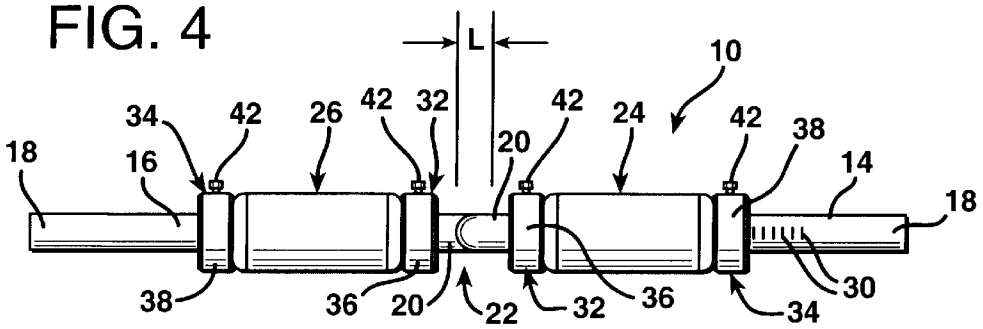
FIG. 4 is a top plan view thereof.

FIG. 1 illustrates an adjustable rotatable exercise device indicated generally at 10. The rotatable exercise device 10 includes an elongated stainless steel bar 12, typically between about three and six feet in length overall and having a diameter of between about one and two inches. The elongated bar 12 is formed as a solid rod and is bent to form a pair of straight linear handgrip sections 14 and 16. The linear handgrip sections 14 and 16 reside in mutually parallel alignment with each other. The handgrip sections 14 and 16 are longitudinally offset from each other by a distance L, which may be about two inches, as illustrated in FIG. 4. The handgrip sections 12 and 14 are also transversely offset from each other by a distance T, indicated in FIG. 2. The transverse offset distance T may, for example, be between about five inches and about 12 inches.

Each of the handgrip sections 14 and 16 of the elongated bar 12 has an outboard end 18 and an inboard end 20. The outboard end 18 is adapted to receive annular shaped weights thereon. The weights are conventional and slide onto the outboard end 18 of both of the handgrip sections 14 and 16 and are held in position by conventional fasteners.

The elongated bar 12 also includes a connecting section 22 which has elbows at both ends that are joined to the longitudinally extending handgrip sections 14 and 16. The connecting section 22 may, for example, be about ten inches in length. The connecting section 22 is oriented transversely relative to the handgrip sections 14 and 16, and, in the embodiments illustrated, is perpendicular thereto. In those embodiments of the invention in which the transverse section forms an angle of less than ninety degrees relative to the handgrip sections, the distance of longitudinal offset L between the handgrip sections will be increased from that illustrated.

Figure 5:
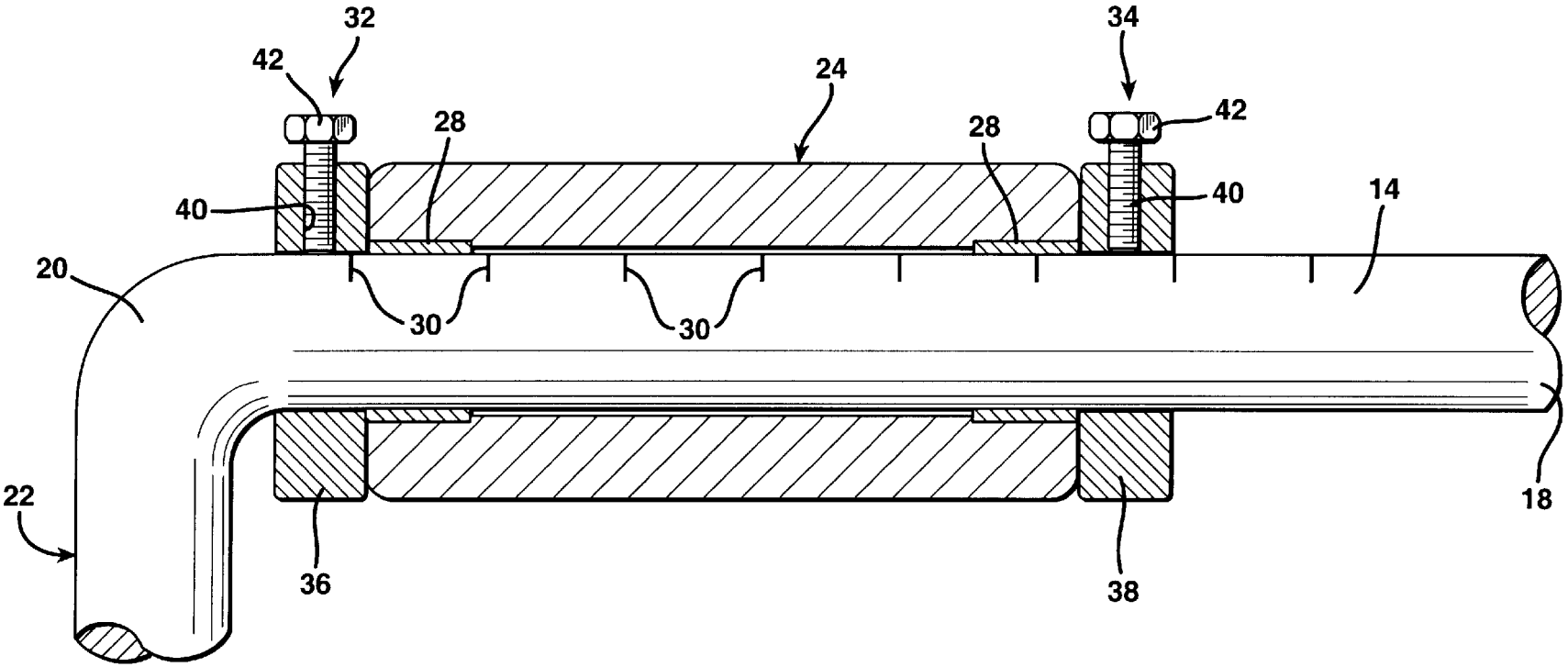
FIG. 5 is a sectional elevational view all of one of the handgrips of the rotatable exercise device of FIG. 1.
Figure 7:
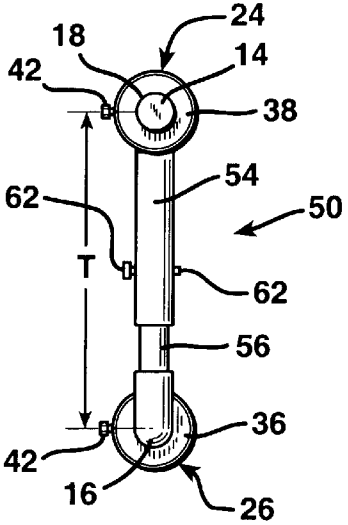
FIG. 7 is an end view of the adjustable rotatable exercise device of FIG. 6.
Figure 8:
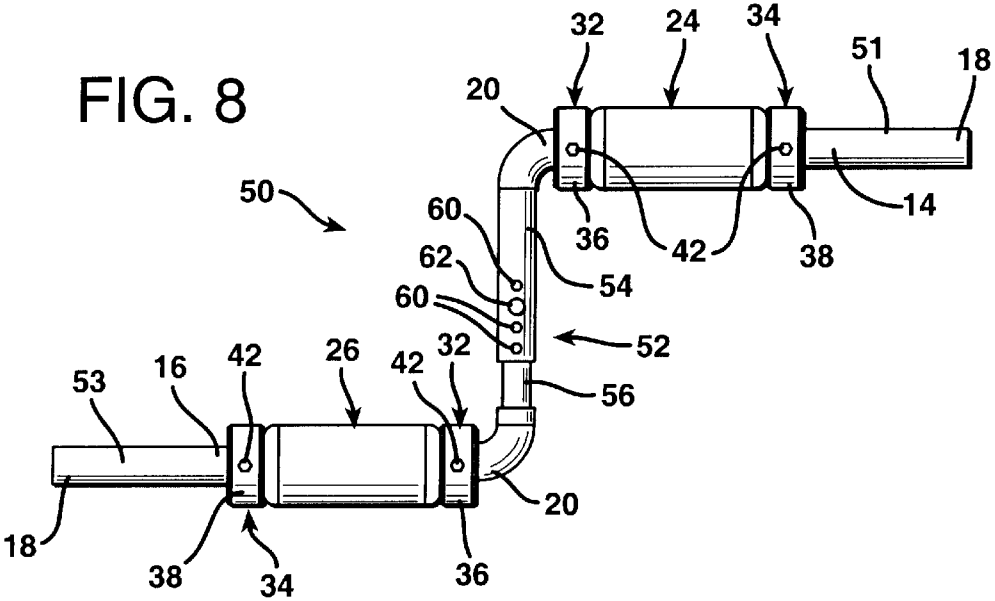
FIG. 8 is a side elevational view of the device of FIG. 6.
Figure 9:
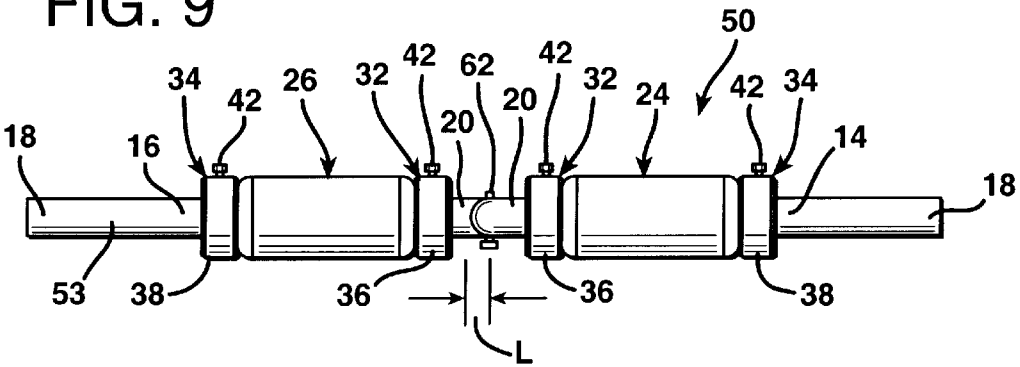
FIG. 9 is a top plan view of the device of FIG. 6.

The adjustable rotatable exercise device 10 also has a pair of tubular annular handgrips 24 and 26 which are formed as sleeves as illustrated in FIG. 5. Each of the handgrips 24 and 26 rides upon a pair of annular bearings 28 that are located at both the inboard and outboard ends of the handgrips 24 and 26. The bearings 28 are set into annular recesses in the inner, cylindrical walls of the handgrip ends. As a consequence, the handgrips 24 and 26 freely rotate upon the bearings 28 about the handgrip sections 14 and 16, respectively.

The handgrips 24 and 26 are shorter than the handgrip sections 14 and 16 of the elongated bar 12. Typically the handgrips 24 and 26 are each about six inches in length, while the handgrip sections 14 and 16 are each about 24 inches in length. Each of the handgrips 24 and 26 is disposed about and resides in rotatable engagement with a separate, associated one of the handgrip sections 14 and 16. That is, the handgrip 24 is coaxially disposed about its associated handgrip section 14 of the elongated bar 12, while the handgrip 26 is disposed coaxially about its associated handgrip section 16.

At least one, and preferably both all of the handgrips 24 and 26 are also movable along their associated handgrip sections 14 and 16, respectively. As illustrated in FIG. 5, each of the handgrip sections 14 and 16 includes a plurality of indicia 30, which are spaced at equal longitudinal intervals along each of the handgrip sections 14 and 16 to provide visual aids in selecting a longitudinal distance of separation for each of the handgrips 24 and 26 from the transverse section 22 of the elongated bar 12. Preferably, the indicia 30 are spaced a distance of about one-half of one inch apart. The indicia 30 may be formed as arcuate scribe marks spaced at uniform, predetermined intervals along the outer surfaces of both of the handgrip sections 14 and 16.

Figure 3:
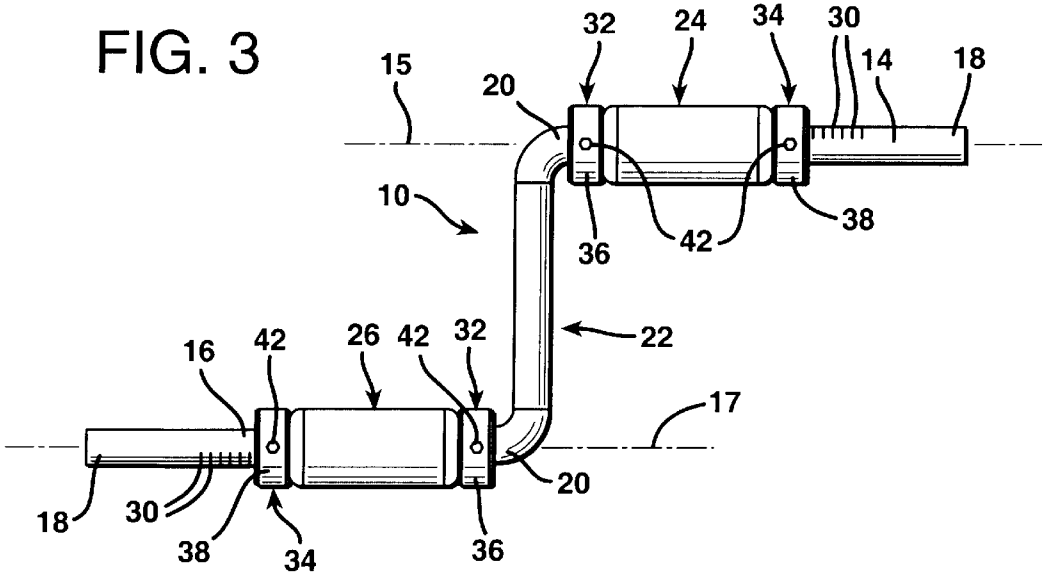
FIG. 3 is a side elevational view of the rotatable exercise device shown in FIG. 1.

Each of the handgrips 24 and 26 must be provided with at least one, and preferably a pair of clamps 32 and 34. The clamps 32 and 34 longitudinally immobilize the handgrips 24 and 26 relative to their associated handgrip sections 14 and 16, respectively. Nevertheless, the clamps 32 permit the relative rotation of the handgrips 24 and 26 about the axes 15 and 17 of their respective handgrip sections 14 and 16. The clamps 32 include an inboard retaining ring 36 while the clamps 34 include an outboard retaining ring 38. The retaining rings 36 and 38 are disposed about their associated handgrip sections 14 and 16 at opposite ends of the handgrips 24 and 26, as illustrated in FIGS. 1, 3, and 5.

Each of the retaining rings 36 and 38 has a radial internally tapped bore 40 defined through its cylindrical annular wall. The clamps 32 and 34 further include set screws 42 engaged in the radial bores 40. When the set screws 42 are tightened, they immobilize the retaining rings 36 and 38 relative to their associated handgrip sections of the elongated bar 12 upon which the retaining rings 36 and 38 are mounted. The clamps 32 and 34 reside in abutting relationship against the bearings 28.

To adjust the longitudinal distance of separation between the handgrips 24 and 26, the set screws 42 of the clamps 32 and 34 on one or both of the handgrip sections 14 and 16 are loosened. The handgrip 24, the handgrip 26, or both handgrips are moved in a sliding manner along their respective handgrip sections 14 and 16 to a selected location relative to the indicia 30 thereon. By loosening the clamps 32 and 34, slidably repositioning the handgrips 24 and 26 along the handgrip sections 14 and 16 of the elongated bar 12, respectively, and by retightening the set screws 42 the user is able to adjust the distance of longitudinal separation between the handgrips 24 and 26 from as little as about two inches to as much as about 15 inches. The ability to adjust the positions of the handgrips 24 and 26 along the lengths of the handgrip sections 14 and 16 allows the user to customize the rotatable exercise device 10 in accordance with the user's shoulder width, arm length and overall physique. In the embodiments illustrated, the handgrips 24 and 26 are both shown positioned quite close to the transverse connecting section 22. However, it is to be understood that they can be moved much further toward the outboard ends 18 of the handgrip sections 14 and 16, if desired.

The embodiment of the rotatable exercise device illustrated in FIGS. 1–4 allows a user to adjust the longitudinal distance of separation between the handgrips 24 and 26, but not the transverse distance of handgrip separation. FIGS. 6–9 of the drawings illustrate another embodiment of a rotatable exercise device 50 that permits not only adjustment of the longitudinal distance of separation between the handgrips 24 and 26, as in the embodiment of FIGS. 1–4, but also adjustment of the transverse distance of handgrip separation T.

The rotatable exercise device 50 includes the same handgrip sections 14 and 16, the same handgrips 24 and 26, and the same clamps 32 and 34 as the rotatable exercise device 10. However, the connecting section 52 of the rotatable exercise device 50 is also adjustable.

Figure 10:
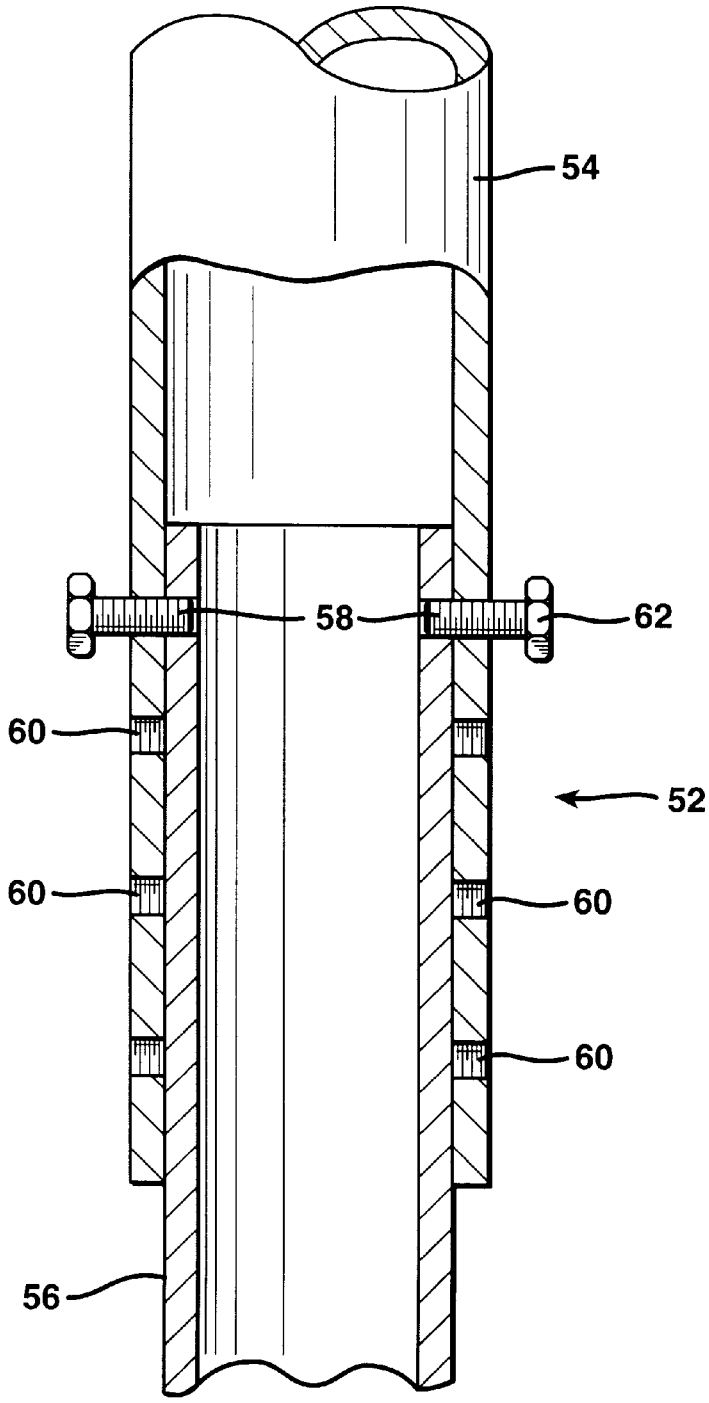
FIG. 10 is a sectional elevational detail of a portion of the transverse connecting section of the adjustable rotatable exercise device of FIG. 6.

The rotatable exercise device 50 is formed of two separate rods 51 and 53 that respectively form the handgrip sections 24 and 26, and an intermediate connecting section 52. The transverse connecting section 52 of the exercise device 50 is comprised of an outer telescoping member 54 and an inner telescoping member 56, as illustrated in FIG. 10. The outer telescoping member 54 has a cylindrical, tubular, annular wall and is joined to the inboard end 20 of the handgrip section 14. The inner telescoping member 56 is also of cylindrical tubular, annular construction, and is joined to the inboard end 20 of the handgrip section 16. The inner telescoping member 56 is at least partially disposed within the outer telescoping member 54. The extremity of the inner telescoping member 56 remote from the handgrip section 16 fits slidably within the outer telescoping member 54. The telescoping members 54 and 56 are slidingly engaged with each other so that they are advanceable and retractable relative to each other in order to vary the distance of transverse offset between the handgrip sections 24 and 26.

The transverse section 52 includes releaseable locking elements for immobilizing the telescoping members 54 and 56 relative to each other. In the rotatable exercise device 50 the releaseable locking elements include diametrically opposed radial openings 58 in the side wall of the inner, hollow, tubular telescoping member 56 and a plurality of pairs of diametrically opposed, internally tapped radial openings 60 in the outer telescoping member 54. The tapped openings 60 are spaced lengthwise along the wall of the tubular, annular structure of the outer telescoping member 54 on diametrically opposite sides of the wall thereof. Locking screws 62, having threaded shanks, serve as locking pins or members. The shanks of the screws 62 are engaged in a selected pair of the tapped openings 60 in the outer telescoping member 54. The screws 62 are also radially aligned with the openings 58 in the inner telescoping member 56. The screws 62 are then threadably advanced inwardly into and through the selected tapped bores 60 in the outer telescoping member 54 and into the openings 58 in the inner telescoping tube 56, which are brought into alignment therewith.

By utilizing the adjustment mechanism shown in FIG. 10, a user can adjust the length T of the connecting section 52 of the rotatable exercise bar 50 to vary the transverse distance of separation between the handgrip sections 14 an 16 from as little as about five inches to as much as about 15 inches. By adjusting the transverse distance of separation between the handgrips 24 and 26 in the rotatable exercise device 50 the user can customize the stroke of the pushing and pulling action exerted by gripping the handgrips 24 and 26 and alternatingly pushing out and pulling in each handgrip 24 and 26.

As is evident in FIGS. 6–10, the rotatable exercise device 50 has handgrips 24 and 26 that can be adjusted in both longitudinal distance of separation from each other and transverse distance of separation from each other. A user is thus afforded considerable flexibility in customizing the rotatable exercise device 50 to accommodate variations in physique, arm length, shoulder width, strength, coordination and other variables between individual users.

The rotatable exercise device according to the invention provides a user with increased flexibility and comfort in performing weight lifting and muscular exercises. The adjustment mechanisms for selectively varying the longitudinal and the transverse distances of separation between the handgrips provides the improved exercise bar of the invention with unique and distinct advantages as contrasted with conventional rotary exercise bars.

Undoubtedly, numerous variations and modifications of the invention will become readily apparent to those familiar with rotary exercise bars. Accordingly, the scope of the invention should not be construed as limited to the specific embodiments depicted and described in the drawing figures.

What is claimed is:

1. In a rotatable exercise device including an elongated bar having a transverse section and a pair of longitudinal handgrip sections extending in opposite directions from opposite ends of said transverse section so that said handgrip sections are longitudinally and transversely offset from each other, and in which separate handgrips are disposed coaxially about and are rotatable relative to said handgrip sections of said elongated bar, the improvement wherein at least one of said handgrips is shorter in length than an associated handgrip section about which it is coaxially disposed and is slidably positionable therealong at alternative selected longitudinal distances from said transverse section of said elongated bar, and further comprising at least one clamp for longitudinally immobilizing said at least one handgrip relative to said associated handgrip section of said elongated bar while permitting free relative rotation therebetween.

2. A rotatable exercise device according to claim 1 wherein both of said handgrips are shorter in length than the associated handgrip sections about which they are respectively coaxially disposed and both of said handgrips are slidably positionable as aforesaid and further comprising at least one clamp as aforesaid for each of said handgrips.

3. A rotatable exercise device according to claim 2 further comprising indicia spaced at equal longitudinal intervals along each of said handgrip sections to provide visual aids in selecting a longitudinal distance for positioning each of said handgrips from said transverse section of said elongated bar.

4. A rotatable exercise device according to claim 1 further comprising a pair of clamps for said at least one handgrip, and said clamps include inboard and outboard retaining rings disposed about said associated handgrip section at opposite ends of said at least one handgrip, and said retaining rings encircle said associated handgrip and each of said retaining rings has a radial, internally tapped bore defined therein, and said clamps further include set screws engaged in said radial bores of said retaining rings, whereby when tightened, said set screws immobilize said retaining rings relative to said associated handgrip section of said elongated bar.

5. A rotatable exercise device according to claim 1 wherein said transverse section of said elongated bar is comprised of telescoping members which are advanceable and retractable relative to each other to vary the distance of transverse offset between said handgrip sections, and releaseable locking elements for immobilizing said telescoping members relative to each other.

6. A rotatable exercise device according to claim 5 wherein said releaseable locking elements are comprised of a radial opening in one of said telescoping members, a plurality of radial openings spaced lengthwise along the other of said telescoping members, and a radial locking pin that is engaged in said radial opening in said one of said telescoping members and with a selected one of said plurality of radial openings in said other of said telescoping members.

7. A rotatable exercise device according to claim 6 wherein said locking pin has an externally threaded shank and is threadably engaged in a radial opening in at least one of said telescoping members.

8. An adjustable rotatable exercise device comprising:

an elongated bar formed with a pair of linear handgrip sections residing in mutually parallel alignment with each other and longitudinally and transversely offset from each other, each of said handgrip sections having an outboard end for receiving weights thereon and an opposite inboard end, and a connecting section joining and extending between said inboard ends of said handgrip sections and oriented transversely relative to said handgrip sections, a pair of tubular, annular handgrips formed as sleeves and shorter than said handgrip sections of said elongated bar, and each of said handgrips is disposed about a separate one of said handgrips sections in rotatable engagement therewith, and at least one of said handgrips is also moveable along an associated handgrip section of said elongated bar about which it is disposed to different distances of longitudinal offset from said connecting section, and said at least one handgrip is provided with at least one clamp that is engageable to longitudinally immobilize said at least one handgrip relative to said elongated bar while permitting free relative rotation between said at least one handgrip and said associated handgrip section.

9. An adjustable rotatable exercise device according to claim 8 further comprising a pair of clamps as aforesaid, and said clamps are each comprised of an annular retaining ring with a radial, internally tapped opening therethrough and an externally threaded set screw threadably engaged in said internally tapped opening, and said retaining rings are positioned about said associated handgrip section of said elongated bar at opposing inboard and outboard ends of said at least one handgrip, whereby said handgrip is rotatable relative to said associated handgrip section, and is restrained from longitudinal movement relative thereto by said retaining rings, when said set screws are tightened against said associated handgrip section.

10. An adjustable rotatable exercise device according to claim 8 further characterized in that said connecting section of said elongated bar is comprised of an outer, telescoping member having an annular wall joined to said inboard end of one of said handgrip sections and an inner telescoping member joined to said inboard end of the other of said handgrip sections, and said inner telescoping member is at least partially disposed within said outer telescoping member, and further comprising a releaseable locking member for releaseably immobilizing said telescoping members relative to each other.

11. An adjustable rotatable exercise device according to claim 10 wherein said locking member is comprised of a locking pin extending through said annular wall of said outer telescoping member and releaseably engaged with said inner telescoping member.

12. An adjustable rotatable exercise device according to claim 11 further comprised of a pair of locking pins as aforesaid coaxially aligned relative to each other and engaging said inner telescoping members from diametrically opposite sides thereof.

13. A rotatable exercise device comprising:

an elongated bar formed with a pair of linear handgrip sections residing in mutually parallel alignment with each other and longitudinally and transversely offset from each other, each of said handgrip sections having an outboard end for receiving weights thereon and an opposite inboard end, and a connecting section joining and extending between said inboard ends of said handgrip sections, and said connecting section is formed of a pair of telescoping members, one of which fits slidingly within the other, and at least one locking member which is engageable to immobilize said telescoping members relative to each other and which is alternatively releaseable to permit said telescoping members to be extended and retracted relative to each other, thereby allowing the length of said connecting section to be selectively adjusted.

14. A rotatable exercise device according to claim 13 employing a pair of locking members as aforesaid wherein said locking members are located on and engage diametrically opposite sides of said telescoping members.

15. A rotatable exercise device according to claim 13 further comprising annular handgrips shorter than said handgrip sections of said elongated bar disposed on said handgrip sections and releaseable clamps on each of said handgrip sections to permit longitudinal adjustment of location of said handgrips along said handgrip sections and said clamps are engageable with said handgrip sections to longitudinally immobilize said handgrips to prevent relative longitudinal movement between said handgrips and said handgrip sections while permitting relative rotational movement therebetween.

16. A rotatable exercise device according to claim 15 wherein said clamps on each of said handgrip sections are comprised of a pair of retaining rings, one of which is located at said inboard end and the other of which is located at said outboard end of an associated handgrip section in abutting relationship with the opposite ends of a handgrip located therebetween.

* * * * *